US006742436B2

(12) United States Patent
Grange et al.

(10) Patent No.: US 6,742,436 B2
(45) Date of Patent: Jun. 1, 2004

(54) AUTOMATIC LOADING PROCESS AND SYSTEM FOR A WEAPON MOUNTED ON A SHIP

(75) Inventors: Gilles Grange, La Fouilleuse (FR); Yves Martinez, Saint-Chamond (FR); Jean-Philippe Delaire, Saint-Rémy les Chevreuses (FR); Joël Roche, Saint-Etienne (FR); Claude Avrard, Saint-Etienne (FR)

(73) Assignee: Giat Industries (FR)

( * ) Notice: Subject to any disclaimer, the term of this patent is extended or adjusted under 35 U.S.C. 154(b) by 0 days.

(21) Appl. No.: 10/116,143

(22) Filed: Apr. 5, 2002

(65) Prior Publication Data

US 2002/0144590 A1 Oct. 10, 2002

(30) Foreign Application Priority Data

Apr. 6, 2001 (FR) ..... 01 04683

(51) Int. Cl.[7] ..... F41A 9/00
(52) U.S. Cl. ..... 89/46
(58) Field of Search ..... 89/46, 45

(56) References Cited

U.S. PATENT DOCUMENTS 2,403,882 A 7/1946 Thomas
2,971,438 A 2/1961 Fox

FOREIGN PATENT DOCUMENTS

| | | |
|---|---|---|
| EP | 0 498 985 A1 | 8/1992 |
| EP | 0 569 342 A1 | 11/1993 |
| FR | 1 405 743 | 11/1965 |

*Primary Examiner*—Charles T. Jordan
(74) *Attorney, Agent, or Firm*—Parkhurst & Wendel, L.L.P.

(57) ABSTRACT

The invention relates to an automatic loading process and system for a large-caliber weapon mounted on a ship and firing ammunition, constituted by charges and projectiles, at a high rate of fire.

The system comprises means allowing at least three isolated areas to be defined for the circulation of the ammunition, a first area in which the charges and projectiles and received and introduced into containers and a second area in which these containers are transferred into an intermediate magazine arranged between the weapon and the first area, and a third area where the weapon is actually loaded with the projectiles and charges, all of these areas being isolated from one another by resistant walls defining hatches providing a passage, and it comprises means to transfer the containers from the first area to the turret then the projectiles and charges into the weapon.

Application to artillery mounted on a ship.

18 Claims, 6 Drawing Sheets

AUTOMATIC LOADING PROCESS AND SYSTEM FOR A WEAPON MOUNTED ON A SHIP

BACKGROUND OF THE INVENTION

The technical scope of the present invention is that of loading systems for a weapon mounted on a ship.

Weapons mounted on ships have a firing rate compatible with the maneuverability of the projectiles and their associated charges. The caliber is generally large and the handling means are placed in the vicinity of the weapon. If two-stage rounds—that is rounds formed of a separate projectile and charge—are handled, this is difficult to manage in the supply of the weapon. The problem is made more difficult if the charge is constituted by modules of different quicknesses. Furthermore, safety on a ship is not compatible with the presence of large quantities of propellant charges in the vicinity of the weapon. That part of the ship providing storage for such charges must therefore be isolated from the manoeuvre area of the gun crew and a safe transfer system.

SUMMARY OF THE INVENTION

The aim of the present invention is to provide a loading system for a weapon present in an isolated space such as on a ship that offers a high level of safety.

The invention thus relates to an automatic loading process for a large caliber weapon mounted on a ship, wherein it comprises the following steps:

- the weapon is separated from the storage magazine by isolated areas fitted with separation barriers,
- the projectiles and the charges are placed in containers ensuring their protection and making them safe to handle, and
- transfer means are provided to take the full and empty containers from one area to the other.

According to one embodiment, at least three separate areas are provided, a first area in which the magazine is supplied with projectiles and charges that are then introduced into containers, a second intermediate area in which the containers are transferred and a third area in which the weapon is supplied by the containers, these three areas being physically separated from one another.

According to another variant, the three areas are arranged vertically.

The invention also relates to an automatic loading system for a large caliber weapon mounted on a ship and firing rounds constituted by charges and projectiles, wherein it comprises means allowing at least three isolated areas to be defined for the circulation of the ammunition, a first area in which the charges and projectiles and received and introduced into the containers ensuring their protection and making them safe to handle, and second area in which these containers are transferred into an intermediate magazine arranged between the weapon and the first area, and a third area where the weapon is actually loaded with the projectiles and charges, all of these areas being isolated from one another by resistant walls defining hatches providing a passage, and wherein it comprises means to transfer the containers from the first area to the turret and the projectiles and charges into the weapon.

According to one embodiment, the magazines to receive the charges and projectiles are arranged in the first area so as to co-operate with first and second transfer means in the first area.

According to another embodiment, the magazines are constituted by an enclosure defining housings in which the charges and projectiles are stored and comprising second transfer means for the projectiles and charges in individual containers.

According to yet another embodiment, the second transfer means for the charges are constituted by a comb provided with gripping means and penetrating inside the magazine to transfer the charge modules into a transport container.

According to yet another embodiment, the second transfer means for the projectiles are constituted by a pusher transferring each projectile into a transport container.

According to yet another embodiment, the first transfer means arranged in the first area are constituted by at least one endless chain driving the charge and projectile containers between a starting loading position at one end and a final position at the other end.

Advantageously, the endless chain is mounted on a frame supporting the drive means for the endless chain, said frame being provided with third transfer means for the projectile and charge containers operating between the final position on the endless chain and an intermediate magazine arranged in the second area.

According to yet another embodiment, the third transfer means are constituted by at least one pusher ensuring the translation of the full containers enclosing the charges and projectiles and the empty containers, able to move between a rest position and an extension position.

Advantageously, a hatch is placed between the intermediate magazine and the first area whose opening is controlled by the pusher control.

Advantageously again, fourth transfer means integrated into the turret ensure the full containers of charges and projectiles and picked up from the intermediate magazine and moved towards the actual loading means of the weapon and the empty containers are transferred towards the intermediate magazine.

According to yet another embodiment, the weapon's loading means are constituted by a slide supporting a drum able to move with respect to the slide, said slide being mobile in elevation with respect to a structure (C) integral with the turret between a supply position where the drum receives the full containers and a delivery position for the projectiles and charges to the weapon.

Advantageously, the slide is integral in traverse rotation with the turret supporting the weapon.

The transfer means define four container flows, a flow of full projectile containers and a flow of full charge containers traveling from the magazine to the weapon, a flow of empty projectile containers and empty charge containers traveling from the weapon to the magazine.

A first advantage of the process and system according to the invention lies in the fact that the weapon may be supplied automatically without the need for an operator.

Another advantage lies in that a high firing rate may be obtained because of the simultaneous transportation of the projectile and the charge used to fire this projectile.

Yet another advantage lies in the safety procured by the separation into sectors or areas isolated from one another.

A further advantage lies in the availability of a store of projectiles and charges in the immediate vicinity of the turret ensuring great reactivity and the capacity to rapidly change targets.

BRIEF DESCRIPTION OF THE DRAWINGS

Other characteristics, particulars and advantages of the invention will become more apparent from the description given hereafter by way of illustration and in reference to the appended drawings, in which.

DETAILED DESCRIPTION OF THE PREFERRED EMBODIMENTS

As indicated previously, the invention proposes a loading process for a large caliber weapon (for example 155 mm) mounted on a ship, said weapon being automatically supplied to ensure a very high rate of fire. By high rate of fire, we mean 10 rounds per minute for this type of weapon. The fact of it being on a ship imposes very stringent safety rules whose aim is to ensure the safety of the ship even in the event of the breakdown or destruction of the weapon or its supply mechanisms. The invention aims to solve this problem by providing an arrangement of areas separated by protective barriers and the conveyance of the propellant charges and projectiles without the need for manual intervention. The protective barriers allow the areas to be isolated from one another with respect to an attack such as to prevent a fire from being communicated, for example, from one area to another, and thereby reducing transmission risks. The conveyance of the charges and projectiles aims to eliminate human intervention in the unstable environment constituted by a ship on the sea. Lastly, we point out that the propellant charges used are generally in the form of combustible bags or blocks (uni-modular charges) that represent a major pyrotechnic hazard for the ship.

Figure 1:
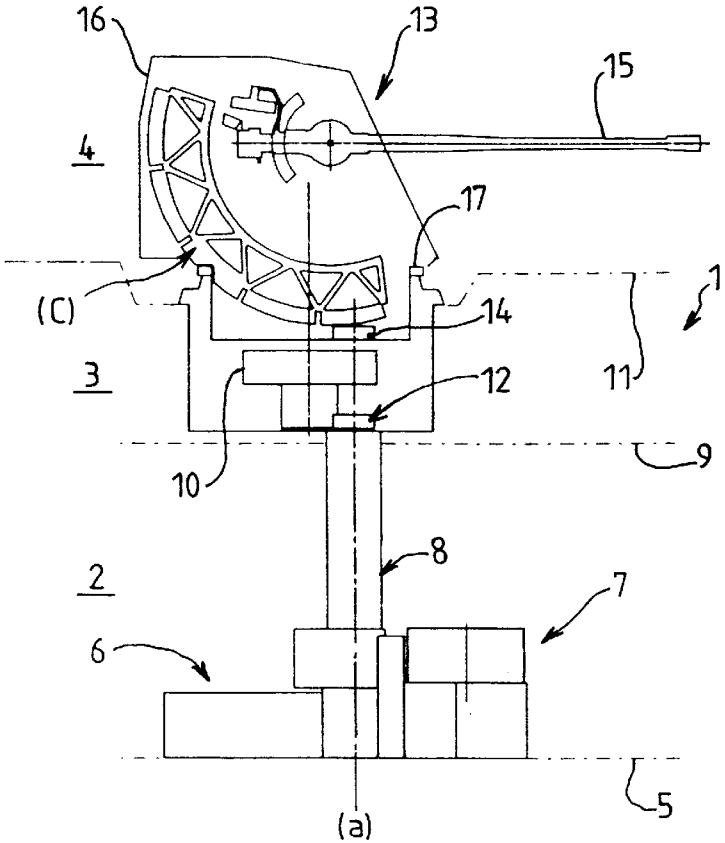
FIG. 1 shows a schematic view of the organization of the system according to the invention.

FIG. 1 is a schematic representation of the system 1 according to the invention arranged in areas 2, 3 and 4 with transfer means going from one area to another. Three areas have been defined on the Figure but it goes without saying that the number of these areas may be multiplied to further increase the level of safety. But three areas according to the invention ensure the required level of safety. In the plane of the Figure, we can note a vertical arrangement although this does not constitute a limitation of the invention. A horizontal arrangement of the system according to the invention may naturally also be provided. The first area 2 is a storage area for a limited number of charges and projectiles. Area 2 may naturally be replenished if necessary from another storage unit not shown. Thus, area 2 limited by the lower deck 5 receives two magazines 6 and 7 arranged on either side of second lower transfer means 8 between area 2 and area 3. In the Figure, magazines 6 and 7 are made integral with the lower transfer means using appropriate means and are provided with the means described hereafter to bring the charges and projectiles towards the transfer means 8. The purpose of the first transfer means 8 is to move the charges and projectiles from the deck 5 to the middle deck 9. The means 8 are dimensioned so as to connect decks 5 and 9 and in the present case we will speak of height since it is on a ship.

In area 3, an intermediate magazine 10 has been arranged to receive the charges and projectiles. This area 3 and thus the magazine 10 are isolated between the middle deck 9 and the upper deck 11. The latter may be the outer deck of the ship, for example. Decks 9 and 11 are isolated by a hatch 12 which, after closing, prevents any communication between these two decks.

In area 4, the weapon 13 is positioned and fastened to the deck 11 isolated from area 3 by a hatch 14 so as to isolate area 4 from area 3 as explained previously. The weapon 13 comprises a cannon 15 mounted on a turret 16. Conventionally, the cannon 15 is mobile in elevation with respect to the turret 16 which is itself mobile in traverse with respect to the deck 11 on a support ring 17. According to one particularity of the invention, means C allow the projectiles and charges to be transferred from a low position in the vicinity of the hatch 14 to a high position to the rear of the cannon 15.

We note that the first transfer means 8, the hatch 12, the magazine 10, the hatch 14 and the means C are aligned during transfer operations along an axis (a).

Figure 2:
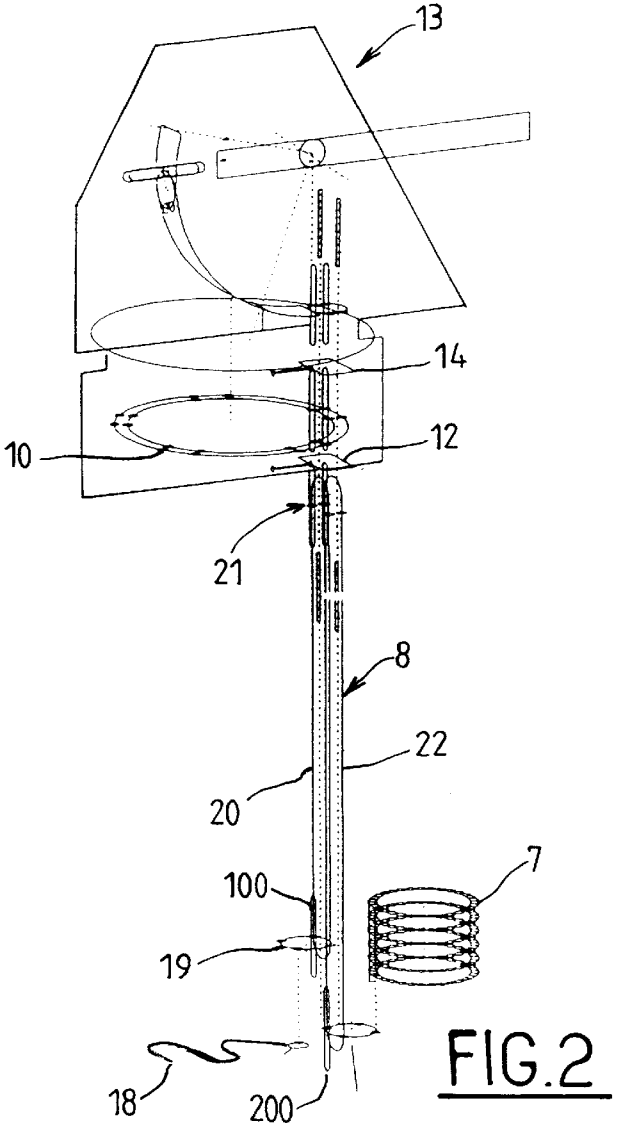
FIG. 2 is a block diagram of the system according to the invention.

FIG. 2 shows a block diagram of the system according to the invention and illustrates the process according to the invention. The projectiles are transferred from the magazine 6 following a transfer line 18 towards a re-looping circuit 19 in a container co-operating with an endless chain 20 geared to the transfer means 8. The position 100 shown in the Figure indicates the point at which a projectile is transferred into a container. This chain 20 brings the projectiles in their containers up to the high position 21 and they are transferred into the intermediate magazine 10. Then the projectiles are transferred from the intermediate magazine 10 into the actual loading means of the weapon 13 integrating means C. This rising flow along the chain 20 allows a projectile inserted in its container to be raised and works in conjunction with a simultaneously descending flow of empty projectile containers. An analogous process is conducted to bring the projectiles in their containers in a rising flow from the magazine 7 to the weapon 13 by means of an endless chain 22 and the intermediate magazine 10. Similarly, the chain 22 defines a descending flow of empty containers. In the Figure, we can see that the magazine 7 comprises six stacked sectors that correspond to the replenishment of six charge modules.

Figure 3:
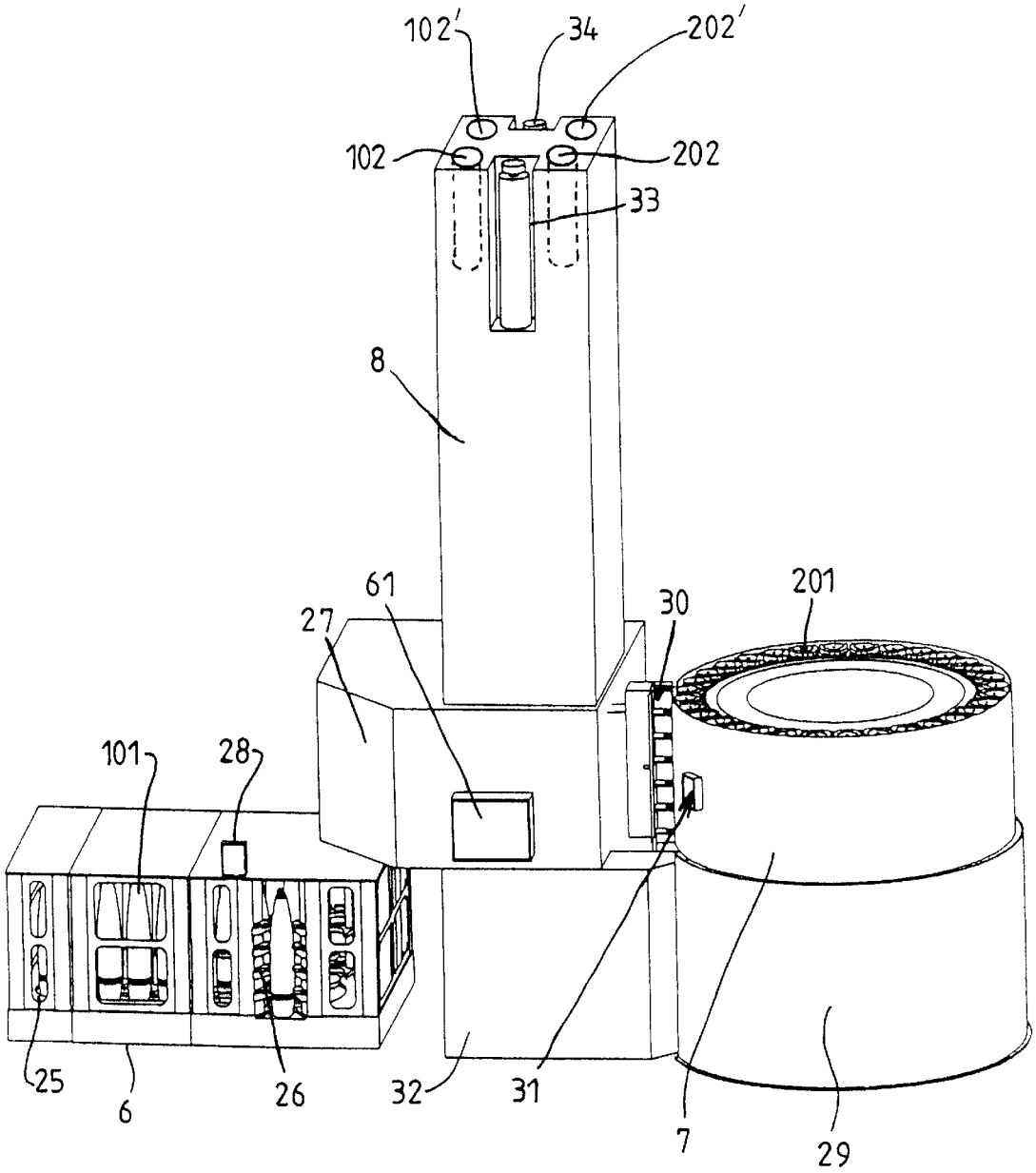
FIG. 3 shows an embodiment of the first transfer means.

FIG. 3 shows the first lower transfer means 8 to which magazines 6 and 7 are harnessed. Magazine 6 is in the shape of a box integrating a revolving assembly 25 into which the projectiles 101 are introduced manually by an operator. An interface 28 allows said operator to validate the type of projectile introduced into the magazine 6. Said assembly is able to receive 30 projectiles, for example. Each projectile 101 is held on the assembly 25 by clips 26 that provide constant pressure but that can be retracted so as to bring the projectile one by one to a selector 27 integral with the means 8. Said selector provides an interface between the magazine 6 and the transfer chain 20 that is not able to be seen in this Figure. Said selector also incorporates second means allowing the projectiles to be transferred towards the chain. In a variant embodiment, the projectiles 101 are introduced into containers integral with the chain 20. To this end, the selector 27 allows the projectile to be transferred in the axis of the empty container placed immediately above and incorporates a actuator that constitutes one of the second transfer means to introduce the projectile into the container. Naturally, the container incorporates means allowing the projectile to be held in place. This arrangement is advantageous in that the erratic movements of the ship have no influence on the projectile's position.

The charges 201 are placed in the magazine 7 that is positioned on a base 29. The charges may be in the form of modules of the same dimension. For example, six modules may constitute a full charge such as is known in the scope of field artillery. A comb 30 constituting the other part of the second transfer means is made integral with means 8 and is able to move between the magazine 7 and the base 29 so as to pick up the modules 201 from the magazine to bring them to the base where they will be taken up by the chain 22 that can not be seen in the Figure. The base encloses a certain number of receptacles or containers in which the modules are introduced by means of the comb. Thus, the comb 30 may pick up a certain number of charge modules from the magazine 7, generally between 3 and 6, and transfer them into the container located at the lower level where they are retained. This operation may be controlled automatically by the fire control, that is to say the number of modules to form the constituted charge is selected according to operational needs. The module container (not shown) naturally incorporates means enabling it to co-operate with the comb 30.

Means 8 are shown equipped with a protective frame enabling the chains 20 and 22 to be isolated from the external environment in area 2. The magazine 7 may contain 180 modules, for example, allowing 30 firings at maximum range if six modules are used each time. The magazine 7 incorporates an interface 31 allowing the operator to control the magazine during manual refilling operations. The magazine 7 also incorporates six revolving assemblies fitted with receptacles immobilizing the modules. The system also incorporates a selector 32 co-operating with the comb 30 to transfer the modules 201 into a container integral with the chain 22. A console 61 is provided for the selector 27 that allows an operator to control the operations to refill the containers with projectiles and charge modules.

This is an advantageous embodiment of the invention since the projectile and modules are transported in a container that ensures their protection and safe handling.

It is understood that the chains 20 and 22 connected, for example, to the same motorization means and constituting an integral part of the first transfer means allow the full containers to be raised and the empty containers to be lowered.

In FIG. 3, we see that the transfer means 8 constituting a lift incorporate a actuator 33 at the upper end allowing a full projectile container 102 and a full charge container 202 to be transferred towards the intermediate magazine as will be described hereafter and a actuator 34 fitted with a clip allowing the empty projectile container 102' and the empty charge container 202' to be taken from the intermediate magazine to be transferred towards the chain 22. These actuators 33 and 34 constituted the third transfer means.

Figure 4:
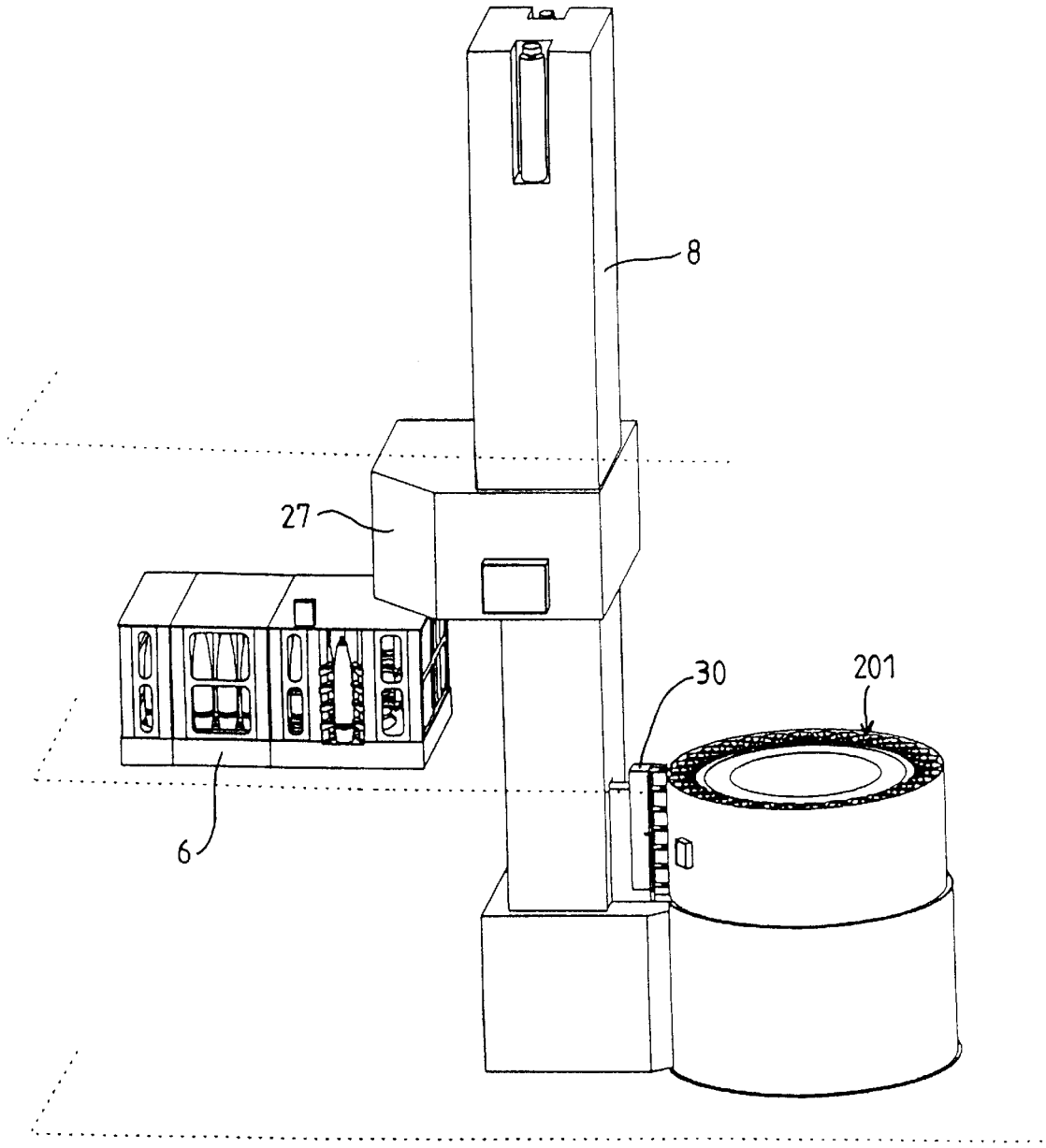
FIG. 4 shows another embodiment of these means.

FIG. 4 shows a variant embodiment of the device in FIG. 3 in which the magazine 6 and selector 27 have been placed at a different upper level.

Figure 5:
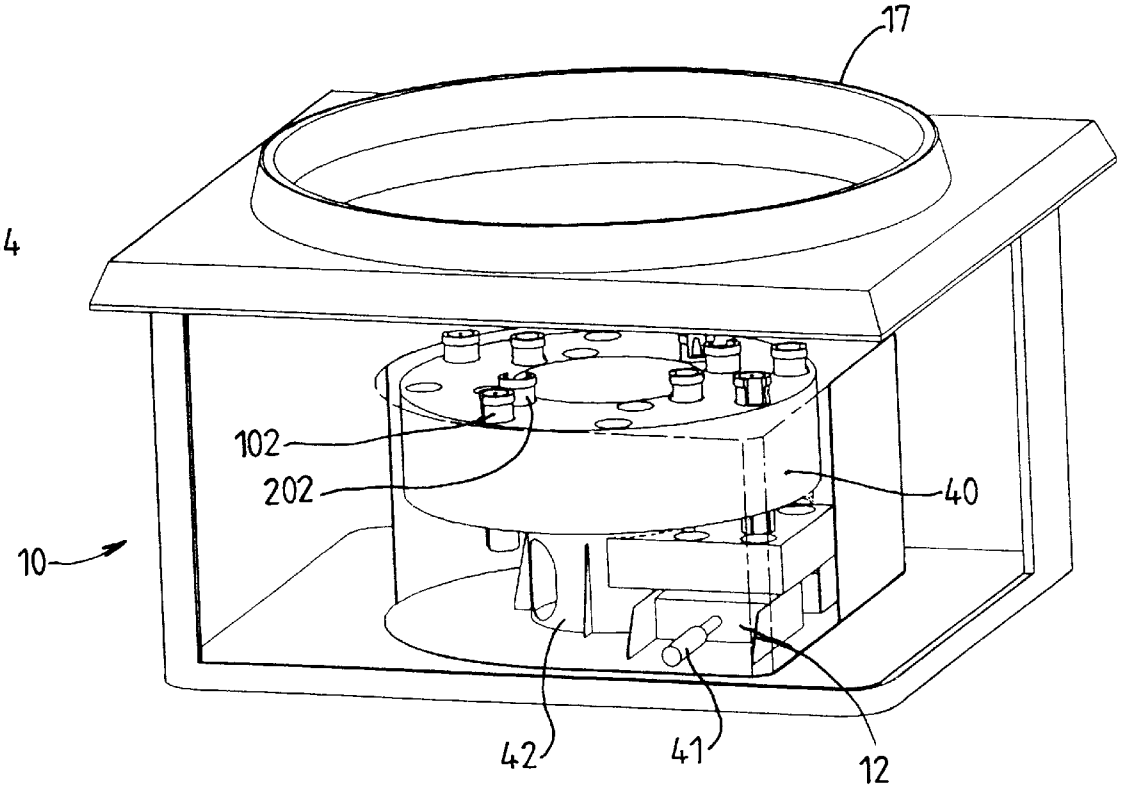
FIGS. 5 and 6 show a view of the intermediate magazine.

FIG. 5 shows the intermediate magazine 10 placed in area 3 and fastened to the middle deck 9. This magazine 10 is in the form of a motorized receptacle 40 centered on the axis of the support ring 17 of the turret 16 delimiting, for example, twenty positions to receive the modules and projectile. These positions are spaced according to two concentric circles one of which receives the projectile containers and the other the module containers, enclosed in their containers 102 and 202. Thus, two positions may be used to transfer a projectile-module assembly towards the turret 16, eight positions to store four assemblies and the other ten positions corresponding to the places associated with each round required for the return of the empty containers from the turret and the arrival of the full containers at the receptacle 40. In this figure, we can see the specific arrangement of the hatch 12 allowing the magazine 10 and the transfer means 8 to communicate with one another. Said hatch incorporates control means 41 activated according to a safety sequence. The receptacle 40 is raised on a base 42 integrating rotational drive means. It goes without saying that when the actuators 33 and 34 are activated, they introduce the module containers and projectile containers into the magazine drum 40 through the base 42. Naturally, means to block the containers are provided in the receptacle 40.

Figure 6:
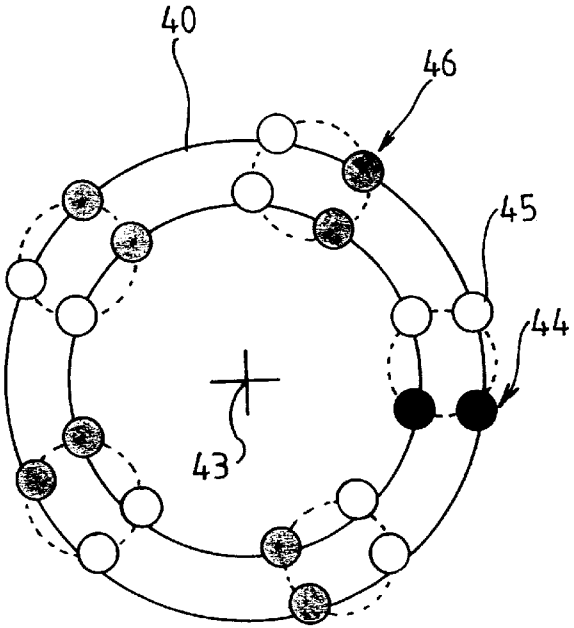

FIG. 6 gives a schematic view of the receptacle 40 revolving around its spindle 43. The ten places shown are alternatively full and empty and we make note of positions 44, 45 and 46. Position 44 of the projectile and module containers represents, for example, the position from which transfer is made towards the actual loading device of the weapon. This transfer is carried out using fourth means integrated in the turret as will be described hereafter. After closing the hatch 12, said means are activated and successively or simultaneously transfer a full projectile container from the intermediate magazine to the weapon and an empty container from the turret to the intermediate magazine. An analogous process is repeated for the charge containers. The hatch 14 (FIG. 1) is thus closed and the receptacle 40 is driven in rotation so as to bring the empty position 45 into the transfer position. After firing and opening the hatch 14, the empty containers are reintroduced into the magazine 40 in position 45 are rotating the receptacle. It goes without saying that after the transfer of the containers towards the turret, position 44 is replenished using transfer means 8. The process is thus repeated to supply the weapon.

Figure 7:
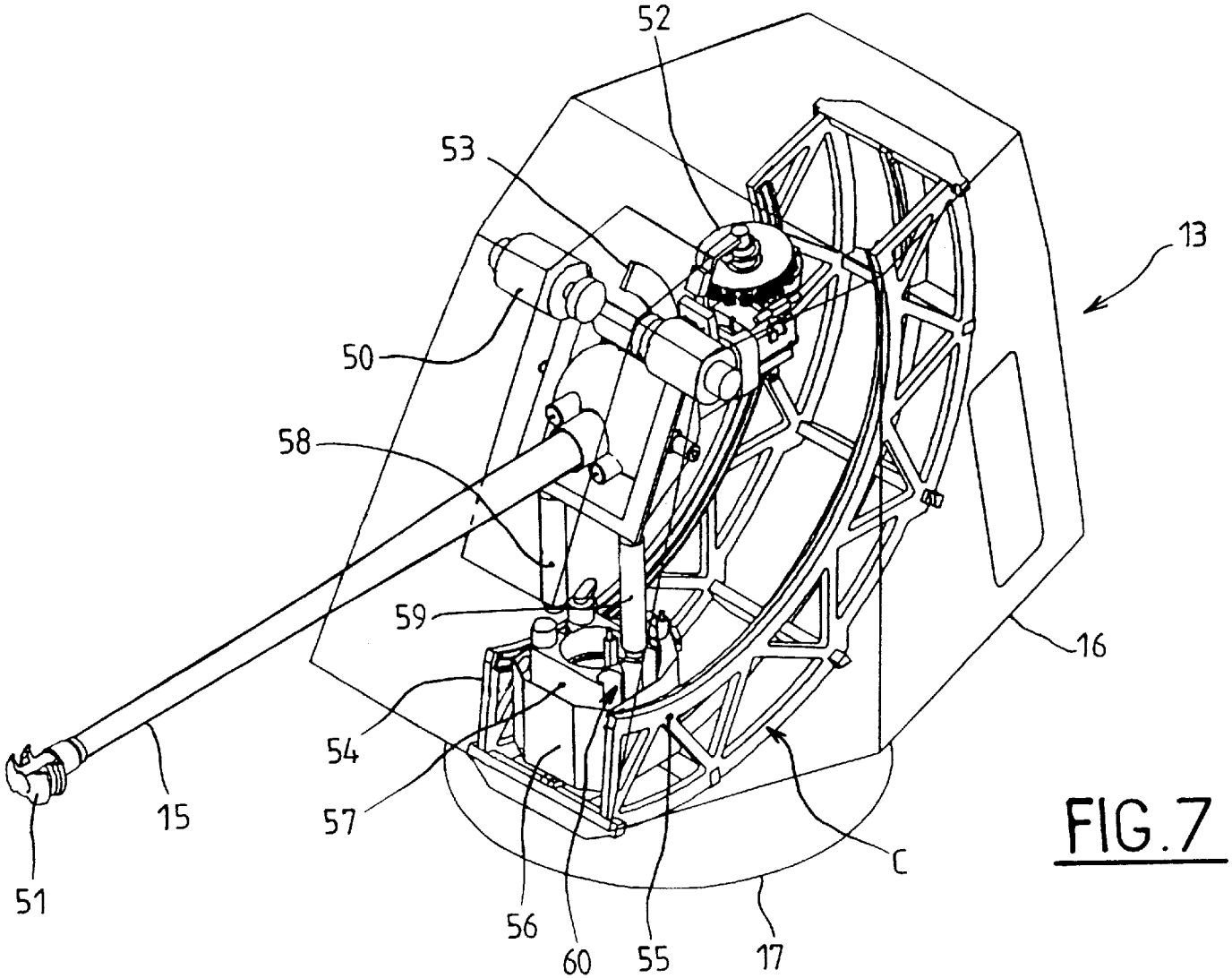
FIG. 7 is a view of the weapon mounted in the turret.

FIG. 7 shows the weapon 13 mounted on the turret 16 able to rotate with respect to the support ring 17. The turret 13 conventionally supports the cannon 15 using a cradle and fitted with equilibrators 50. The 155 mm type cannon is notably fitted with a muzzle brake 51 of a known type and a squib carrier 52 to fire the modules introduced into the cannon chamber. This structure is known in itself and does not require further description. The turret 16 is able to move in traverse around the support ring 17 and the cannon itself is mobile in elevation with respect to a notched quadrant 53. The weapon is supplied with projectiles and modules as follows. A guiding structure or means C is fixed in the turret and is in the form of a cage shaped as the arc of a circle and incorporating two sides 54 and 55 joined together and receiving a loading slide 56. This slide 56 is mounted sliding between a supply position at one end of the structure (C) shown in the figure, said lower position, and a loading position at the other end, said high position. Naturally, the slide 56 is activated by drive means that are not shown. During its displacement, the slide 56 drives a magazine drum 57 receiving the empty and full containers. In the lower position, the drum 57 may be supplied from the intermediate magazine 10 whatever the position of the turret in elevation or of the cannon in traverse. In fact, the drum 57 in the lower position is aligned with the shaft of the support ring 17 on which position 44 of the receptacle 40 is aligned. The turret is equipped with two actuators 58 and 59 constituting fourth transfer means co-operating with the drum 57 to take one 58 of the full containers from the intermediate magazine 40 to this drum 57 and the other 59 to transfer the empty containers from the drum to the magazine 40. In the Figure, we see that the drum incorporates four spaces 60 two of which contain containers in the vicinity of the side 54 of the structure C and two of which are empty in the vicinity of the side 55. The process is as follows. After the hatch 14 is opened (FIG. 1), the two actuators 57 and 58 are activated, one to take a container enclosing a projectile, for example, to introduce it into the drum 57 in the vicinity of the side 54, whereas the other actuator pushes the empty container into the receptacle 40. After this, the same operation is carried out to take a container enclosing charge modules and to bring back an empty container. When the drum 57 is equipped with two containers, one enclosing the projectile and the other the modules, the slide 56 is made to move up to the high position, that is to the rear of the cannon. Using an actuator not shown, the projectile is firstly transferred from the container towards the weapon chamber then the modules are transferred from the container to the chamber. The classical firing sequence may now begin.

Figure 8:
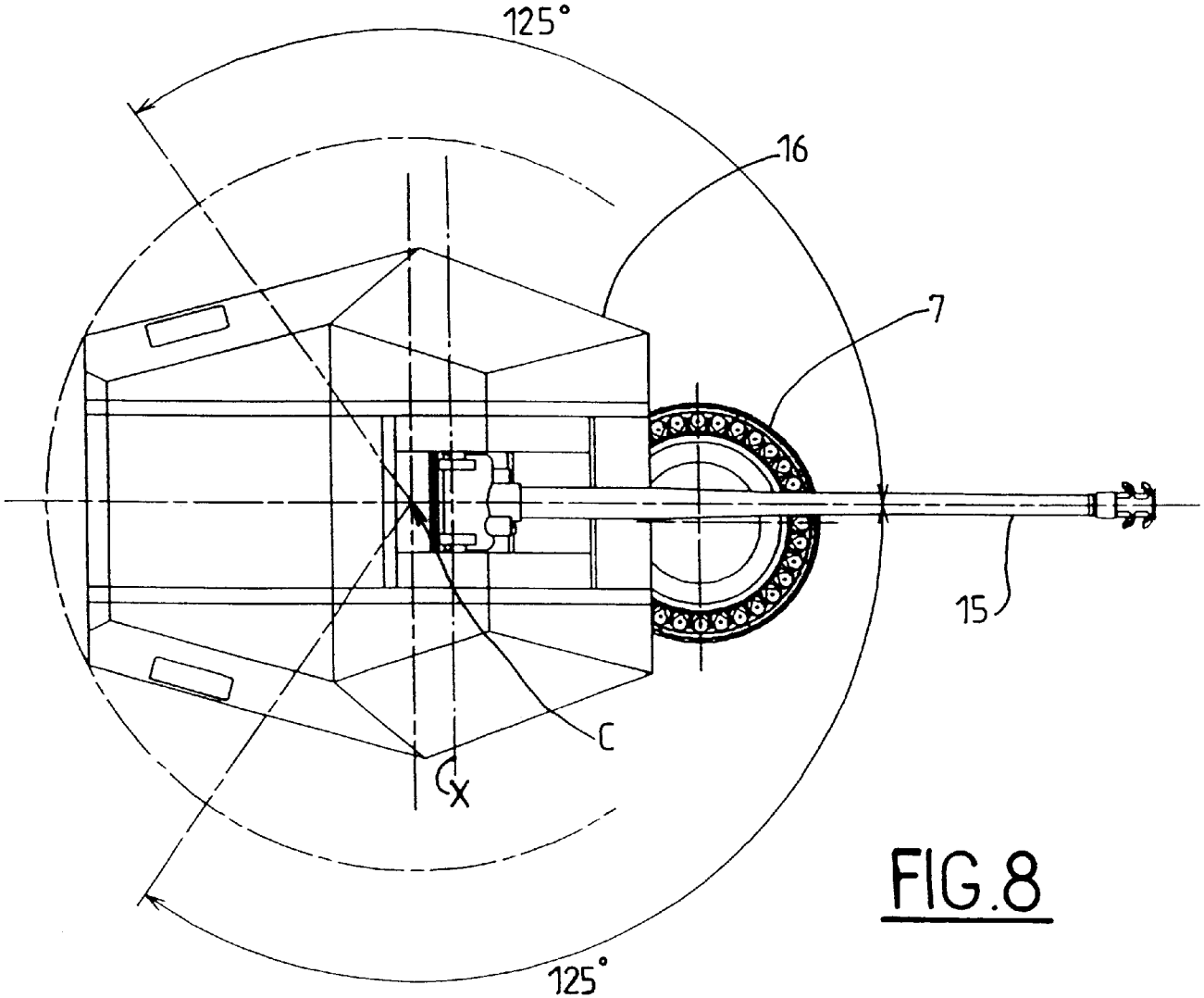
FIG. 8 shows one position of the turret with respect to the charge magazine.

FIG. 8 shows a top view of the turret 16 indicating the position of the magazine 7 that encloses the charge modules. We see that the turret 16 and thus the cannon 15 are able to move in traverse up to an angle of 125° on either side of a starting position around the elevation axis through point C. The cannon's 15 traverse axis X is also schematized in the Figure. We also see the offset position of the magazine 7 with respect to point C perpendicular to which the charges and projectiles must be brought.

What is claimed is:

1. An automatic loading system for a large caliber weapon mounted on a ship, the system comprising:

a storage area comprising a projectile magazine and a charge magazine;

an intermediate area comprising an intermediate magazine for receiving and holding charges and projectiles;

a weapon area comprising a cannon mounted in a turret, said weapon area for loading charges and projectiles into the cannon, wherein the storage area, the intermediate area and the weapon area are mutually separated by protective walls;

containers for holding charges and containers for holding projectiles; and first transfer means comprising an endless conveyor for conveying containers holding charges and containers holding projectiles between the storage area and the weapon area, and for conveying empty containers between the weapon area and the storage area.

2. The automatic loading system according to claim 1, further comprising:

second transfer means for conveying projectiles from the projectile magazine and placing the projectiles into respective containers.

3. The automatic loading system according to claim 2, wherein the second transfer means further comprises:

a gripping means for conveying charges from the charge magazine and placing the charges into respective containers.

4. The automatic loading system according to claim 3, wherein the gripping means comprises a comb for retrieving simultaneously a predetermined number of charges and placing the retrieved charges into a container.

5. The automatic loading system according to claim 2, wherein the second transfer means further comprises:

a selector cooperating with the second transfer means for controlling container loading sequence and contents.

6. The automatic loading system according to claim 2, further comprising:

third transfer means for transferring containers holding charges and containers holding projectiles from the first transfer means to the intermediate magazine and for transferring empty containers from the intermediate magazine to the first transfer means.

7. The automatic loading system according to claim 6, wherein the third transfer means comprises at least two pushers and pusher control means for ensuring translation of full containers and empty containers between a rest position and an extension position.

8. The automatic loading system according to claim 7, further comprising:

fourth transfer means located in the turret for transferring containers holding charges and containers holding projectiles from the intermediate magazine to the turret and for transferring empty containers from the turret to the intermediate magazine; and loading means for transfer of charges and projectiles from respective containers into the cannon.

9. The automatic loading system according to claim 8, further comprising:

first and second sealable hatches each located in alignment with the first transfer means, the first hatch for communication between the intermediate area and the storage area and the second hatch for communication between the intermediate area and the weapon area, the hatches for passage therethrough of containers holding charges, containers holding projectiles and empty containers.

10. The automatic loading system according to claim 9, wherein the pusher control means controls movement of the first sealable hatch and the turret comprises control means for controlling movement of the second sealable hatch.

11. The automatic loading system according to claim 10, wherein the loading means for loading the cannon comprises:

a slide supporting a drum for movement with respect to the slide, the slide being mobile in elevation with respect to a structure integral with the turret, the structure located between a supply position where the drum receives full containers and, a delivery position for delivering projectiles and charges from the full containers to the cannon.

12. The automatic loading system according to claim 11, wherein the slide is integral in traverse rotation with the turret.

13. The automatic loading system according to claim 6, wherein the first transfer means defines four separate container flows comprising a first flow of containers holding charges and a second flow of containers holding projectiles between the storage area and the weapon area, and a third flow of empty charge containers and a fourth flow of empty projectile containers between the weapon area and the storage area.

14. A method for automatically loading a large caliber weapon mounted on a ship including a storage area comprising a projectile magazine and a charge magazine, containers for holding charges, containers for holding projectiles, an intermediate area comprising an intermediate magazine for receiving and holding charges and projectiles, a weapon area comprising a cannon mounted in a turret, wherein the storage area, the intermediate area and the weapon area are mutually separated by protective barriers, and first transfer means comprising an endless conveyor, the method comprising:

conveying containers holding charges and containers holding projectiles with the endless conveyor between the storage area, the intermediate area and the weapon area, and conveying empty containers with the endless conveyor between the weapon area and the storage area.

15. The automatic loading method according to claim 14, further comprising second transfer means for conveying projectiles, the method further comprising:

conveying projectiles by the second transfer means, from the projectile magazine and placing the projectiles into respective containers.

16. The automatic loading method according to claim 15, further comprising third transfer means for transferring containers, the method further comprising:

transferring containers holding charges and containers holding projectiles from the first transfer means to the intermediate magazine, and transferring empty containers from the intermediate magazine to the first transfer means.

17. The automatic loading method according to claim 16, further comprising fourth transfer means for transferring containers, and loading means for loading the cannon, the method further comprising:

transferring containers holding charges and containers holding projectiles from the intermediate magazine to the turret and transferring empty containers from the turret to the intermediate magazine; and transferring by the loading means, charges and projectiles from respective containers into the cannon.

18. A method for automatically loading a large caliber weapon comprising a storage area and weapon area, the method comprising:

first conveying containers holding charges and second conveying containers holding projectiles between the storage area and the weapon area, and third conveying empty charge containers and fourth conveying empty projectile containers between the weapon area and the storage area, wherein said first, second, third and fourth conveyances are separate flows.

* * * * *